United States Patent [19]

Anteau

[11] Patent Number: 5,037,237

[45] Date of Patent: Aug. 6, 1991

[54] BOAT HULL PROTECTOR AND METHOD OF HANDLING A BOAT

[76] Inventor: Paul D. Anteau, 421 E. Streicher St., Toledo, Ohio 43608

[21] Appl. No.: 399,175

[22] Filed: Aug. 28, 1989

[51] Int. Cl.[5] ..... B63C 3/06

[52] U.S. Cl. ..... 405/3; 294/74; 405/1

[58] Field of Search ..... 405/1-4; 294/74, 75, 76, 77

[56] References Cited

U.S. PATENT DOCUMENTS

| | | | |
|---|---|---|---|
| 2,771,315 | 11/1956 | Fenwick . | |
| 3,524,543 | 8/1970 | Bundy et al. | 294/74 X |
| 3,622,025 | 11/1971 | Peterson | 294/74 X |
| 4,039,217 | 8/1977 | Bryant | 294/74 |
| 4,200,325 | 4/1980 | Johnson | 294/74 |
| 4,350,380 | 9/1982 | Williams | 294/74 |
| 4,441,748 | 4/1984 | St. Germain | 294/74 |
| 4,653,419 | 3/1987 | Brandon . | |

FOREIGN PATENT DOCUMENTS

| | | | |
|---|---|---|---|
| 1280690 | 11/1961 | France | 294/74 |

*Primary Examiner*—Dennis L. Taylor

*Attorney, Agent, or Firm*—Willian Brinks Olds Hofer Gilson & Lione

[57] ABSTRACT

A pair of opposed protectors for protecting the hull of a boat from abrasion or other contact damage by a sling used in lifting the boat during launching, haul out or the like, each protector being in the form of an elongate member which is positioned between the boat hull and the portion of the sling which would otherwise engage the hull, each protector being affixed at one end thereof to the boat by reverse U-shaped members which releasably engage the lifeline of the boat to permit the position of the protector to be adjusted longitudinally of the boat for alignment with the sling, each protector having a polyvinyl chloride hull contacting face with a layer of cellular polyvinyl chloride or cellular polyethylene backing material bonded thereto, a two sided pressure sensitive tape being affixed to each protector adjacent the opposed end thereof for further releasably affixing each protector to the boat. The opposed ends of the protectors in a pair are adjacent to one another, but do not transmit tensile loads therebetween. A second, like pair of protectors is used when the boat handling device uses a second sling which is spaced apart from the first sling, the second pair of protectors protecting the hull from damage by the second sling.

17 Claims, 1 Drawing Sheet

BOAT HULL PROTECTOR AND METHOD OF HANDLING A BOAT

BACKGROUND OF THE INVENTION

1. Field of the Invention

This invention relates to an article of manufacture for protecting the hull of a boat from abrasion or other damage by virtue of its contact with a sling during the launching of the boat or during its haul out. This invention also relates to a method of handling a boat during launching, take out or the like to avoid sling damage to the hull of the boat.

2. Description of the Prior Art

Pleasure boats, especially keeled sailing boats, are customarily handled by a suspended, spaced apart pair of slings which engage the hull of the boat at longitudinally spaced apart locations along the hull. In this method each sling engages the hull for a substantial lineal distance upwardly from the bottom of the hull along each side, during the placement of the boat in water and during its removal therefrom, for example, at the beginning and end of each sailing season. The slings, which can be subjected to rather large tensile loads, are typically formed from canvas or other coarse, strong textile material, and can scratch or otherwise damage a relatively smooth boat hull, for example, a fiberglass hull coated with a gel coat substance, since rather large loadings can be placed on the portion of the hull which is in surface to surface contact with the slings. The problem is compounded when the hull engaging portion of the sling picks up dirt or gravel, which is frequently present in marinas where such operations are frequently conducted and which can easily remain in engagement with the sling by virtue of the coarseness of the sling material. Further, in a marina usually the same set of suspended slings is used repeatedly over a short period of time and without attempting to clean debris therefrom between launchings or removals. The use of slings in the manner described can also result in staining of the hull of a boat suspended therefrom or in scratches to the sheer lines of the boat. The problem of damage to an article from a hoisting sling was recognized in U.S. Pat. No. 2,771,315. However, it is not known if the teachings of this reference have ever been successfully adapted for use with boats, especially keeled sailing boats.

SUMMARY OF THE INVENTION

According to the present invention there is provided a protector for protecting the hull of a boat from abrasion or other damage that could otherwise result from contact with a sling during the launching or removal of the boat, and a method of handling a boat which involves the use of a sling in which sling contact damage is prevented. The protector is usually a part of an opposed set of like articles each of which is suspended along one of the sides of the boat, for example, by hooks or clips from the cable-like lifeline of the boat, between the hull and the portion of the sling which supports the hull, approximately down to the water line of the boat. A similar set of opposed protectors is preferably used in conjunction with the other sling, since it is customary to use a pair of slings in the handling of a boat. Opposed protectors which are used with a given sling have free ends, that is, they are not connected in tensile load transmitting relationship to one another. As a result, the protectors do not transmit the tensile load of the boat, and can be fabricated from a smooth, soft, load absorbant material to protect the hull surface from contact with the rather coarse slings. A material which has been found to perform very well in a hull protector according to the present invention is a laminated sheetlike material with an outer, hull engaging layer of polyvinyl chloride backed by a flexible, expanded or cellular material, such as expanded or cellular polyvinyl chloride or cellular polyethylene. Such a material, cut into strips a few inches wider than the width of a standard sling, which allows for adequate clearance in its placement with respect to a standard sling, is sufficiently light in weight to be easily handled, it is sufficiently durable to be reused many times, it has sufficient flexibility to readily conform to the contours of a typical boat hull, it has sufficient bulk to be relatively stable in its position in a somewhat windy, outdoor environment, and it can be folded into a compact, cylindrical configuration when not in use for easy storage. Further, securing means, for example, a low peel strength adhesive device, such as a two-sided pressure sensitive adhesive strip, can be placed on each hull protector, near the bottom free end thereof, to assist in releasably securing the bottom free end of the protector to the hull.

Accordingly, it is an object of the present invention to provide an article of manufacture to protect the hull of a boat from abrasion or other contact damage from the handling of the boat by a device which suspends the boat by at least one sling. It is a further object of the present invention to provide such a hull protector which can be readily handled, reused on many occasions, and conveniently stored between periods of use. It is also an object of the present invention to provide a method of handling a boat involving the use of a sling in which sling contact damage to the boat is substantially prevented.

For a further understanding of the present invention and the objects thereof, attention is directed to the drawing and the following brief description thereof, to the detailed description of the preferred embodiment, and to the appended claims.

DETAILED DESCRIPTION OF THE PREFERRED EMBODIMENT

Figure 1:
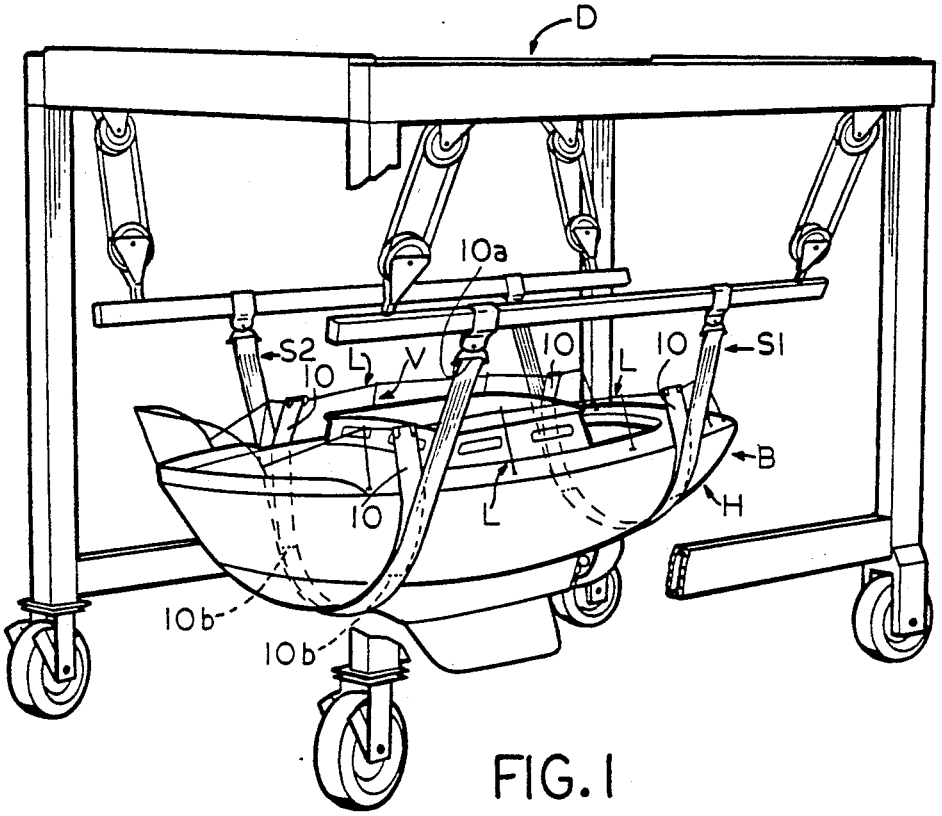
FIG. 1 is a perspective view illustrating the use of hull protectors according to a preferred embodiment of the present invention in the handling of a keeled boat by a sling-type boat handling device according to the method of the present invention, part of the structure of the boat handling device being broken away for the sake of clarity.

FIG. 1 illustrates a keeled boat, indicated generally by reference character B, suspended from a pair of generally U-shaped slings S1 and S2, respectively. The free ends of each of the slings S1 and S2 are suspended from a conventional, transportable boat handling device D, portions of which are omitted for the sake of clarity, and the boat handling device can be used to place the boat B in its slip at a marina at the start of a season, to remove the boat B from its slip at the end of the season, and to store the boat B during the off-season or until suitable cradle or support members can be placed thereunder.

Since the entire weight of the boat B is supported on the portions of the slings S1 and S2 which underlie the hull H of the boat B, relatively high unit loadings, in terms of pounds per square inch, will develop against the portions of the hull H which overlie the slings S1 and S2, especially since the width of each of the slings S1 and S2, typically 10–16 inches, is small in comparison to the length of a typical boat. These loadings can result in abrasion or other contact damage or staining of the hull H if it is directly contacted by the slings S1 and S2, since the slings, which must bear substantial tensile loads, are typically made of a coarse, tensile load bearing textile material such as canvas. Further, the slings S1 and S2 are normally used in an environment where they are exposed to dirt and other debris which tends to stick thereto because of the coarseness of the material of the slings. The problem of sling contact damage is especially severe in the case of a boat with a fiberglass hull H due to the customary use of a rather soft, gel coat coating material on the exterior thereof.

According to the present invention, damage to the hull H of the boat B from the slings S1 and S2 is prevented by the use of an opposed pair of elongate, double-ended hull protectors 10 at the location of each of the slings S1 and S2, a hull protector 10, which includes a length or strip of a flexible, nonabrasive material 12, being placed along the hull H between the hull H and each of the slings S1 and S2. Each hull protector 10, which preferably is about 20 inches wide to provide adequate clearance along each edge of a typical b10–16 inch wide sling, has a first end 10*a* and a second or free end 10*b*, and the first end 10*a* is provided with attachment means, illustratively in the form of spaced apart U-shaped clips 14. The clips 14 permit each hull protector 10 to be readily detachably suspended from a lifeline L which is typically a part of the boat B, and which is supported above the deck thereof by vertical supports or stanchions V, and at a readily adjustable position along such lifeline L. The hull protector 10 is radially aligned with the adjacent portions of the sling, S1 or S2 as the case may be, before the sling is tightened against the hull H, so that no portion of the hull H directly bears against either of the slings S1 or S2. To assist in the accurate positioning of the second end 10*b* of each of the hull protectors 10, for example, on a windy day, a length of two-sided pressure sensitive tape 16 can be placed therealong, the tape 16 having a high peel strength on its face which engages the length of material 12 and a low peel strength on its opposed face, which is adapted to contact the hull H of a boat B during the use of the hull protector 10. Such a tape is available from 3 M Company under the product designation "Hi Tack/ Medium Tack" tape, product number 6425. Typically, the tape should be placed approximately 12 inches from the free end of a 72 inch long protector 10, which permits some trimming of the protector if it is too long for a given boat.

The free ends of an opposed pair of hull protectors 10 are not in tensile load transmitting relationship with one another, each one preferably stopping at the water line of the boat in question. Hence, the strips 12 need not have high tensile load bearing capabilities, since, for all practical purposes, they need only bear the weight of any portion therebelow, and can therefore be designed based on their non-abrasion characteristics. A material which is very suitable for use in the manufacture of the strips 12 is a composite sheetlike material having a polyvinyl chloride facing 12*a* which is adapted to bear directly against the hull H, laminated or otherwise bonded to a flexible cellular or expanded backing material 12*b*, such as cellular polyvinyl chloride or cellular polyethylene, preferably in an overall thickness of approximately 0.08–0.10 inch with a weight of approximately 25 ounces per running yard, based on a 20 inch width and a thickness of 0.10 inch, or a weight of approximately 22½ ounces per running yard, based on a 20 inch width and a thickness of approximately 0.08 inch. Such material will have good anti-abrasion characteristics on its face 12*a* which contacts the hull H, and the ability to absorb surface irregularities on the adjacent sling, S1 or S2 as the case may be, because of the cellular nature of the backing material 12*b*. Further, such material will be sufficiently flexible to readily conform to the curvature of the hull H, while having sufficient bulk to hang properly even in mildly windy conditions. The clips 14 may be readily and securely affixed to the strip 12 by a pair of spaced apart rivets 18, and yet each hull protector 10 will be sufficiently light in weight to be easily handled, it will be reusable many times and rollable into a tight cylindrical configuration for easy storage between uses. Material of this type is produced in substantial quantities for various other applications, for example for automotive dashboards, door panels and upholstery, and, thus, is readily available in a variety of colors and at reasonable prices. If desired, another film layer can be laminated to the outside of the cellular layer 12*b*, for example, a layer with a wood grain effect outer surface, for the sake of appearance. Such a material is available from the Polymer Division of Gen Corp. in Toledo, Ohio under the product designation "tri-laminate" 0.08 inch and 0.10 inch thicknesses.

While the hull protector 10 has been described in relation to a keeled sail boat, it is also understood that it can be used with a power boat, in which case it should be somewhat shorter. For power boat usage, the clips 14 are preferably replaced with stitched fasteners, for example "Velcro" fasteners, to permit attachment to vertical stanchions or horizontal rails which are characteristic of such boats. Further, the use of releasable suction cups in place of the pressure sensitive tape 16 is also contemplated for releasably securing the second or bottom end of a hull protector to a boat, both as to protectors for keeled sail boats and as to protectors for power boats.

Although the best mode contemplated by the inventor for carrying out the present invention as of the filing date hereof has been shown and described herein, it will be apparent to those skilled in the art that suitable modifications, variations, and equivalents may be made without departing from the scope of the invention, such scope being limited solely by the terms of the following claims.

What is claimed is:

1. A boat hull protector for protecting the hull of a boat from sling damage during the handling of the boat by a device having at least one sling for supporting the boat from the bottom, the hull having a soft, abradable surface, said protector having:

an elongate member adapted to be positioned between the hull of the boat and a portion of the sling to prevent the portion of the sling from contacting the surface of the hull, said elongate member having a hull contacting layer with a face which is substantially less abrasive than the sling and a layer of a cellular, polymeric material bonded to the opposed face of said hull contacting layer to form a unitary structure; and affixing means attached to said elongate member adjacent an end thereof for releasably affixing said protector to said boat with said elongate member positioned between the hull and the portion of the sling, said affixing means permitting adjustment of the position of said elongate member longitudinally along the hull.

2. A protector according to claim 1 wherein said hull contacting layer is a thin layer of polyvinyl chloride, and wherein said cellular polymeric material is selected from the group consisting of cellular polyvinyl chloride and cellular polyethylene.

3. A protector according to claim 2 wherein said unitary structure has a thickness of approximately 0.08–0.10 inch and a weight of approximately 25 ounces per running yard, based on a 20 inch width and a thickness of 0.10 inch.

4. A boat hull protector for protecting the hull of a boat from sling damage during the handling of the boat by a device having at least one sling for supporting the boat from the bottom, said protector having:

an elongate member adapted to be positioned between the hull of the boat and a portion of the sling to prevent the portion of the sling from contacting the hull, said elongate member having a hull contacting layer with a face which is substantially less abrasive than the sling; and affixing means attached to said elongate member adjacent an end thereof for releasably affixing said protector to said boat with said elongate member positioned between the hull and the portion of the sling, said affixing means permitting adjustment of the position of said elongate member longitudinally along the hull;

wherein said elongate member further comprises a layer of cellular, polymeric material bonded to the opposed face of said hull contacting layer to form a unitary structure, said unitary structure being load absorbent;

wherein said hull containing layer is a thin layer of polyvinyl chloride, wherein said cellular polymeric material is selected from the group consisting of cellular polyvinyl chloride and cellular polyethylene; and wherein said affixing means comprises a spaced apart pair of inverted generally U-shaped clips for releasably and slidably engaging a cablelike lifeline on a boat and means for attaching one leg of each of said pair of generally U-shaped clips to said elongate member.

5. A boat hull protector for protecting the hull of a boat from sling damage during the handling of the boat by a device having at least one sling for supporting the boat from the bottom, said protector having:

an elongate member adapted to be positioned between the hull of the boat and a portion of the sling to prevent the portion of the sling from contacting the hull, said elongate member comprising a hull contacting layer with a face which is substantially less abrasive than the sling; and affixing means attached to said elongate member adjacent an end thereof for releasably affixing said protector to said boat with said elongate member positioned between the hull and the portion of the sling, said affixing means permitting adjustment of the position of said elongate member longitudinally along the hull;

wherein said elongate member further comprises a layer of a cellular, polymer material bonded to the opposed face of said hull contacting layer to form a unitary structure, said unitary structure being load absorbant, sufficiently flexible to conform to the curvature of the hull, sufficiently bulky to hang properly, sufficiently light in weight to be easily handled, and sufficiently flexible to be able to be rolled into a cylinder for convenient storage;

wherein said hull contacting layer is a thin layer of polyvinyl chloride, and wherein said cellular polymeric material is cellular polyvinyl chloride;

wherein said unitary structure has a thickness of approximately 0.08–0.10 inch and a weight of approximately 25 ounces per running yard, based don a 20 inch width and a thickness of 0.10 inch; and wherein said affixing means comprises a spaced apart pair of inverted generally U-shaped clips for releasably and slidably engaging a cablelike lifeline on a boat and means for attaching one leg of each of said pair of generally U-shaped clips to said elongate member.

6. A protector according to claim 1 wherein said elongate member has another, opposed end, and further comprising;

adhesive means attached to said elongate member for releasably securing said opposed end to said hull.

7. A protector according to claim 7 wherein said elongate member has a width which is not substantially greater than 20 inches and a length which is substantially greater than said width.

8. Means for protecting opposed sides of the hull of a boat from sling damage during the handling of a boat by a device having at least one sling which supports the hull at the bottom and along both sides extending upwardly therefrom, the hull having a soft, abradable surface, said means comprising:

a first protector disposed along one side of the boat and a second protector disposed along the other side of the boat;

said first protector comprising;

a first elongate member adapted to be positioned along said one side of the boat between the hull of the boat and a first portion of the sling to prevent the first portion of the sling from contacting the surface of the hull, said first elongate member having a hull contacting layer with a hull contacting face which is substantially less abrasive than the first portion of the sling and a layer of a cellular, polymeric material bonded to the opposed ace of said hull contacting layer to form a unitary structure, and first affixing means attached to said first elongate member adjacent an end thereof for releasably affixing said first protector to said boat with said first elongate member positioned along said one side of the boat between the hull and the first portion of the sling, said second protector comprising;

a second elongate member adapted to be positioned along said other side of the boat between the hull of the boat and a second portion of the sling to prevent the second portion of the sling from contacting the surface of the hull, said second elongate member having a hull contacting layer with a hull contacting face which is substantially less abrasive than the second portion of the sling and a layer of a cellular, polymeric material bonded to the opposed face of said hull contacting layer to form a unitary structure, and second affixing means attached to said second elongate member adjacent an end thereof for releasably affixing said second protector to said boat with said second elongate member positioned along said other said of the boat between the hull and the second portion of the sling.

9. Means according too claim 8 wherein said hull contacting layer of each of said first elongate member and said second elongate member is a thin layer of polyvinyl chloride and wherein said cellular polymeric material of each of said first elongate member and said second elongate member is selected from the group which consists of polyvinyl chloride and cellular polyethylene.

10. Means for protecting opposed sides of the hull of a boat from sling damage during the handling of a boat by a device having at least one sling which supports the hull at the bottom and along both sides extending upwardly therefrom, said means comprising:

a first protector disposed along one side of the boat and a second protector disposed along the other side of the boat;

said first protector comprising;

a first elongate member adapted to be positioned along said one side of the boat between the first portion of the sling to prevent the sling from contacting the hull, said first elongate member having a hull contacting layer with a hull contacting face which is substantially less abrasive than the first portion of the sling, and first affixing means attached to said first elongate member adjacent an end thereof for releasably affixing said first protector to said boat with said first elongate member positioned along said one side of the boat between the hull and the first portion of the sling, said second protector comprising;

a second elongate member adapted to be positioned along said other side of the boat between the hull of the boat and a second portion of the sling to prevent the second portion of the sling from contacting the hull, said second elongate member having a hull contacting layer with a hull contacting face which is substantially less abrasive than the second portion of the sling, and second affixing means attached to said second elongate member adjacent an end thereof for releasably affixing said second protector to said boat with said second elongate member positioned along said other said of the boat between the hull and the second portion of the sling;

wherein each of said elongate member and said second elongate member further comprises a layer of a cellular, polymeric material laminated to the opposed face of said hull contacting layer to form first and second unitary structures, respectively, each of said first and second unitary structures being load absorbent;

wherein each of said first affixing means and said second affixing means comprises a spaced apart pair of inverted generally U-shaped clips for releasably and slidably engaging a cablelike lifeline on a boat and means for attaching one leg of each of said pair of generally U-shaped clips to said first elongate member or said second elongate member, respectively, to permit the adjustment of the positions of said first elongate member and said second elongate member longitudinally along the hull.

11. Means according to claim 10 wherein each of said first and second unitary structures has a thickness of approximately 0.08–0.10 inch and a weight of approximately 25 ounces per running yard, based on a 20 inch width and a thickness of 0.10 inch.

12. Means according to claim 8 wherein each of said first elongate member and said second elongate member has a second end which is opposed to said end of said each of said first elongate member and said second elongate member, respectively, and wherein said second end of said first elongate member and said second end of said first elongate member are adapted to be positioned adjacent to one another, but in non-tensile load conducting relationship with one another.

13. Means according to claim 12 wherein said first elongate member comprises first adhesive means attached to said first elongate member adjacent said second end thereof for releasably securing said first elongate member to said hull at said one side of the boat, and wherein said second elongate member comprises second adhesive means attached to said second elongate member adjacent said second end thereof for releasably securing said second elongate member to said hull at said other side of the boat.

14. Means according to claim 12 wherein each of said first adhesive means and said second adhesive means comprises a length of a two-sided, pressure sensitive tape with a first, hull contacting face of a relatively low peel strength and a second, opposed face of a relatively high peel strength.

15. Means according to claim 8 wherein each of said first protector and said second protector has a width which is not substantially greater than 20 inches and a length which is substantially greater than said width.

16. The method of handling a boat during launching, take out and the like and without abrasion or other contact damage to the hull of the boat, said method comprising the steps:

providing a lifting device having at least one sling for supporting the boat from the bottom and at least partly along opposed first and second sides of the hull;

positioning a first protector along one side of the boat, between one side of the hull and a first portion of the sling which supports said one side of the hull to prevent direct contact damage between said one side of the hull and said first portion of the sling; and positioning a second protector along the other side of the boat, between the other side of the hull and a second portion of the sling which supports said other side of the hull to prevent direct contact damage between said other side of the hull and aid second portion of the sling;

each of said first protector and said second protector having a hull engaging face layer which is formed from a material which is substantially less abrasive than the material of the sling;

wherein said first protector is an elongate member having a first end and a second end, wherein said first protector is positioned along the none side of the boat by releasably securing said first end thereof to a portion of the boat, wherein said second protector is an elongate member having a first end and a second end, and wherein said second protector is positioned along the other side of the boat by releasably securing said first end thereof to a portion of the boat; and wherein the boat has a cablelike lifeline, wherein said first protector is releasably secured to the boat by releasably suspending the first end thereof from the lifeline, and wherein said second protector is releasably secured to the boat by releasably suspending the first end thereof from the lifeline, the positions of the first protector and the second protector being adjustable, longitudinally of the boat, for alignment with the first portion of the sling and the second portion of the sling, respectively.

17. A method according to claim 16 and further comprising, further releasably securing said first protector to said boat at a location adjacent said second end of said first protector, and further releasably securing said second protector to said boat at a location adjacent said second end of said second protector.

* * * * *

UNITED STATES PATENT AND TRADEMARK OFFICE

CERTIFICATE OF CORRECTION

PATENT NO. : 5,037,237

DATED : August 6, 1991

INVENTOR(S) : Paul D. Anteau

Figure 2:
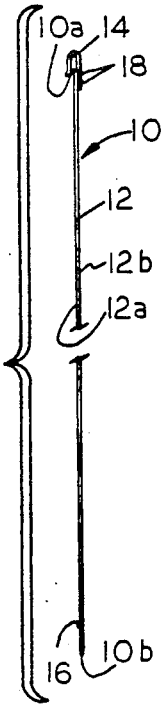
FIG. 2 partly broken away side view of a hull protector according to the present invention.
Figure 3:
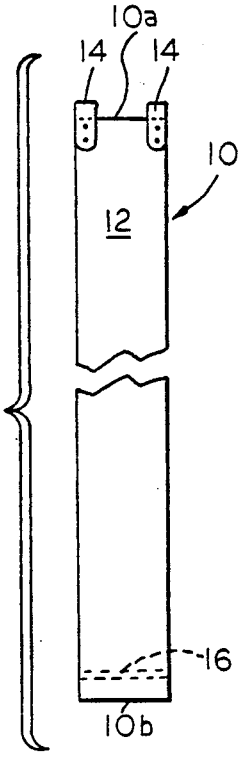
FIG. 3 is a partly broken away end view of the hull protector of FIG. 2
Figure 4:
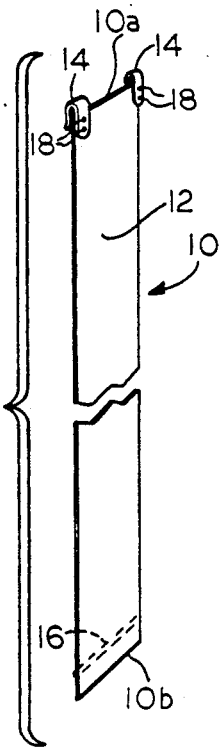
FIG. 4 is a partly broken away perspective view of the hull protector of FIGS. 2 and 3.

It is certified that error appears in the above-identified patent and that said Letters Patent is hereby corrected as shown below:

Column 2, line 51, after FIG. 2 --is a-- should be inserted.

Column 3, line 33, after typical "b" should be deleted.

Column 4, line 36, after "tri-laminate" --both in-- should be inserted.

Claim 5 - column 6, line 19, "don" should be --on--.

Claim 7 - column 6, line 32, "Claim 7" should be --Claim 1--.

Claim 8 - column 6, line 54, "ace" should be --face--.

Claim 16 - column 8, line 61, "aid" should be --said--.
column 9, line 1, "none" should be --one--.

Signed and Sealed this

Twenty-fourth Day of November, 1992

*Attest:*

DOUGLAS B. COMER

*Attesting Officer*

*Acting Commissioner of Patents and Trademarks*